US007679015B2

(12) United States Patent
Cheng

(10) Patent No.: US 7,679,015 B2
(45) Date of Patent: Mar. 16, 2010

(54) KEYPAD ASSEMBLY FOR ELECTRONIC DEVICE

(75) Inventor: Chih-Wei Cheng, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 0 days.

(21) Appl. No.: 12/345,361

(22) Filed: Dec. 29, 2008

(65) Prior Publication Data

US 2009/0178907 A1 Jul. 16, 2009

(30) Foreign Application Priority Data

Jan. 14, 2008 (CN) ..... 2008 1 0300089

(51) Int. Cl.
*H01H 9/00* (2006.01)

(52) U.S. Cl. ..... 200/310

(58) Field of Classification Search ..... 200/310
See application file for complete search history.

(56) References Cited

U.S. PATENT DOCUMENTS

| | | | | |
|---|---|---|---|---|
| 4,671,688 | A * | 6/1987 | Brashears | 400/714 |
| 5,807,002 | A * | 9/1998 | Tsai | 400/494 |
| 7,186,936 | B2 * | 3/2007 | Marcus et al. | 200/310 |
| 7,238,896 | B2 * | 7/2007 | Nakayama et al. | 200/10 |
| 7,357,523 | B2 * | 4/2008 | Kao et al. | 362/23 |
| 2007/0039809 | A1 * | 2/2007 | Aihara et al. | 200/310 |
| 2008/0053800 | A1 * | 3/2008 | Hoyle | 200/310 |
| 2008/0179173 | A1 * | 7/2008 | Jung et al. | 200/314 |
| 2008/0277253 | A1 * | 11/2008 | Kenmochi | 200/314 |

* cited by examiner

*Primary Examiner*—Michael A Friedhofer
*Assistant Examiner*—Lheiren Mae A Anglo
(74) *Attorney, Agent, or Firm*—D. Austin Bonderer

(57) ABSTRACT

A keypad assembly includes a pressing surface layer, a pattern layer, an elastic layer, a light guiding layer, and a pressing bottom layer. The pattern layer is under the pressing surface layer. The elastic layer is located between and interlocks the pattern layer and the light guiding layer by adhesive. The pressing bottom layer adheres to the light guiding layer. The keypad assembly has an ideal appearance by lights collection of the light guiding layer. User can feel comfortable when pressing the keypad assembly because of the elastic layer's buffering effect.

15 Claims, 3 Drawing Sheets

KEYPAD ASSEMBLY FOR ELECTRONIC DEVICE

BACKGROUND

1. Field of the Invention

The present invention generally relates to keypad assemblies, specifically to a keypad assembly for an electronic device, such as a mobile phone.

2. Description of Related Art

A typical keypad assembly for a given electronic device includes an upper shell and a keypad. The upper shell defines a plurality of holes therethrough. The keypad has a plurality of keys formed on a top surface thereof and a plurality of switch points on a bottom surface thereof. Each switch point corresponds to a key of the keypad. The keypad is mounted under the upper shell and each key is exposed through a corresponding hole of the upper shell. However, the keys of the keypad are typically made of stiff material and the switch points are made of metal. When a user presses the key, a finger of the user may feel uncomfortable due to the hardness of the keys and switch points.

Currently, a thin keypad assembly for an electronic device may include a pressing surface layer and a pressing bottom layer. The pressing surface layer is made of transparent elastic rubber and the pressing bottom layer is made of hard polycarbonate. The pressing surface layer and the pressing bottom layer are made integral by adhesive or hot press molding. Patterns on the keypad assembly are formed on the pressing bottom layer by printing before adhesive or hot press molding. However, the thickness of the keypad assembly may be so thin that the user may feel uncomfortable when pressing the keypad assembly. Also, because collecting the light rays under the pressing bottom layer can be difficult in the area of the patterns, it is difficult to achieve ideal vision effect. Also, if the thin keypad assembly cannot eliminate static electricity, the static electricity may generate undesirable influence for the electronic device.

Therefore, there is room for improvement within the art.

BRIEF DESCRIPTION OF THE DRAWINGS

Many aspects of the present keypad assembly can be better understood with reference to the following drawings. The components in the drawings are not necessarily drawn to scale, the emphasis instead being placed upon clearly illustrating the principles of the present keypad assembly. Moreover, in the drawings, like reference numerals designate corresponding parts throughout the several views.

DETAILED DESCRIPTION OF THE EMBODIMENTS

The present keypad assembly is suitable for electronic devices, such as mobile phones, personal digital assistants (PDAs), and etc.

Figure 1:
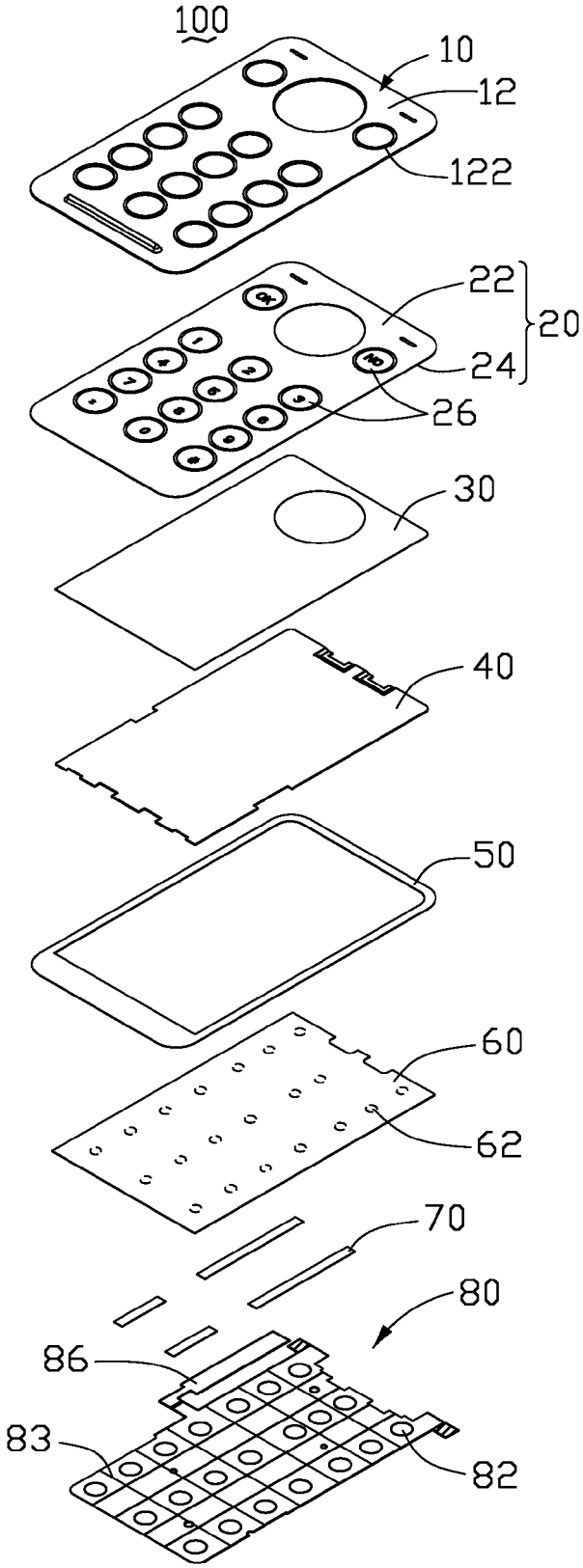
FIG. 1 is an exploded, isometric view of a keypad assembly, in accordance with an exemplary embodiment.
Figure 2:
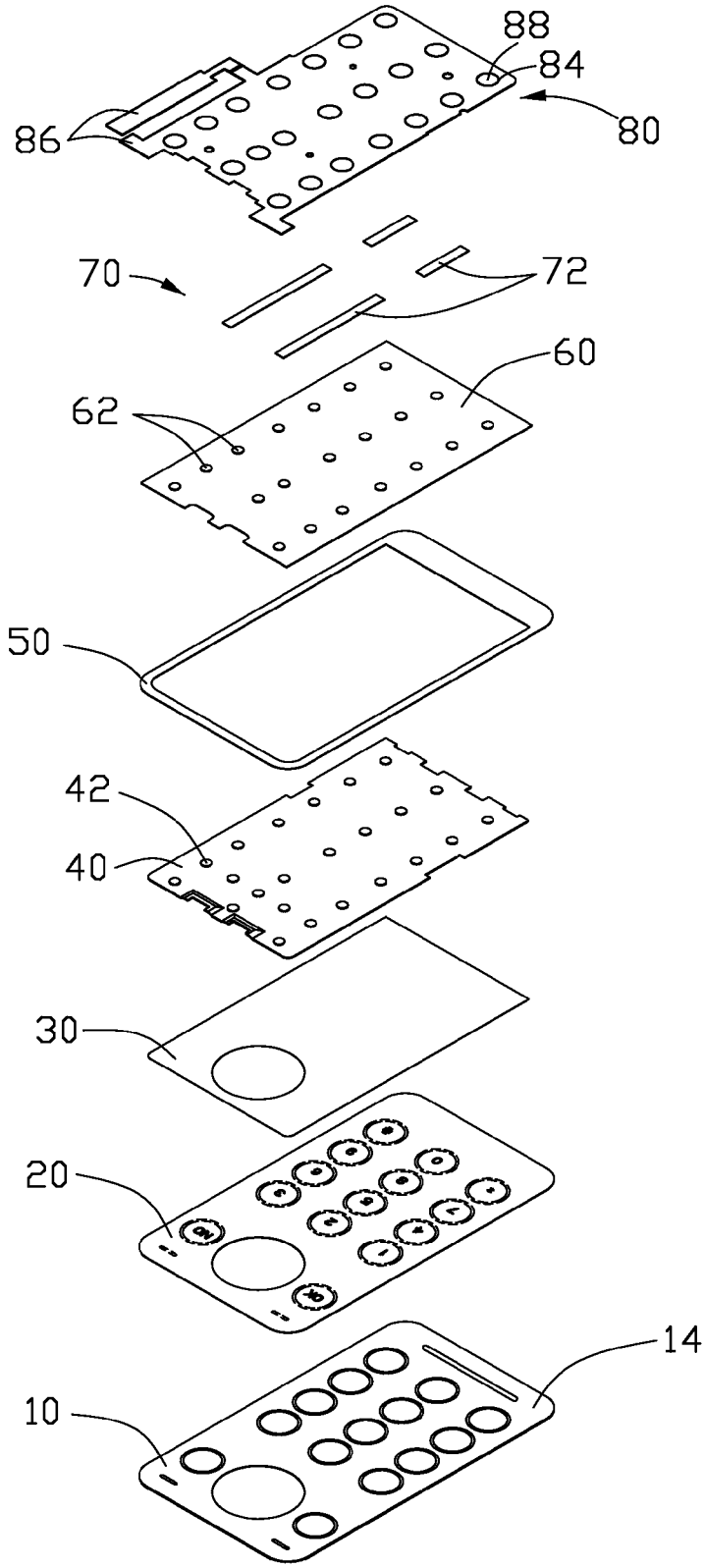
FIG. 2 is similar to FIG. 1, but viewed from another aspect.
Figure 3:
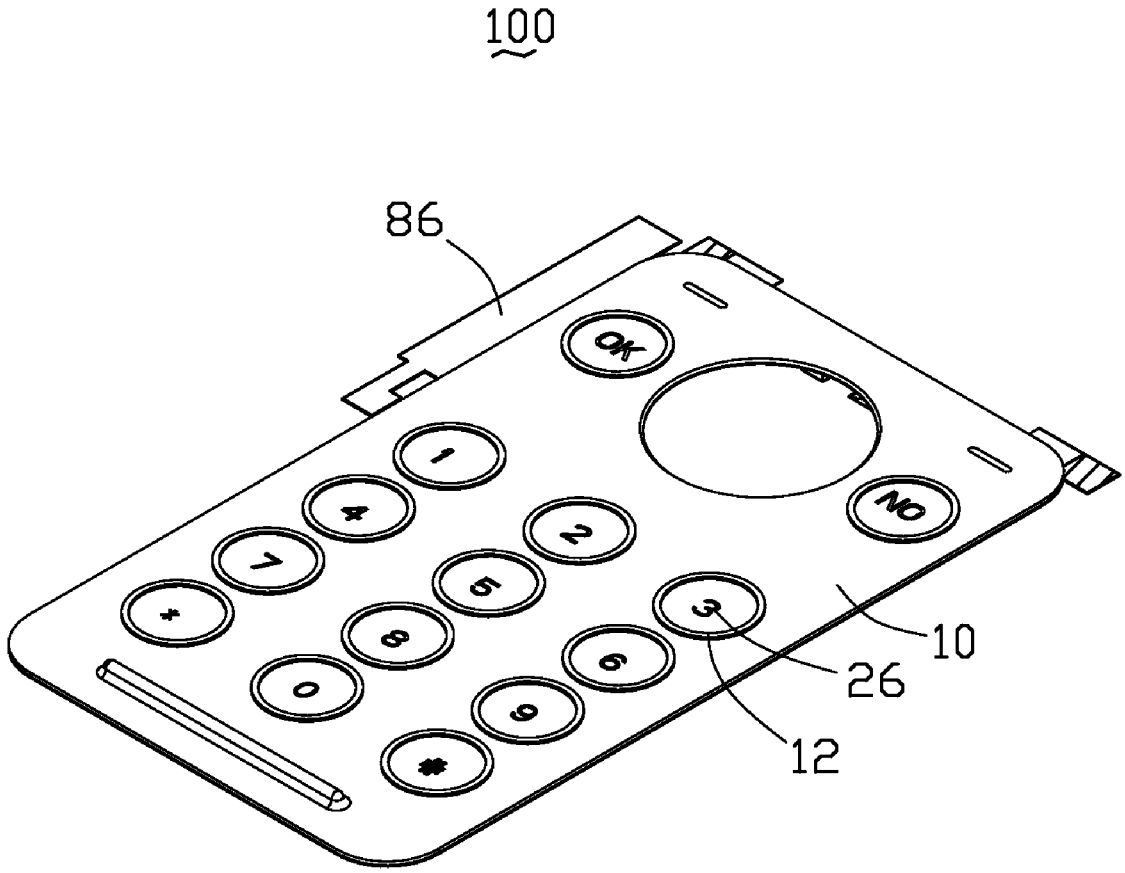
FIG. 3 is an assembled, isometric view of the keypad assembly.

Referring to FIGS. 1 and 2, a keypad assembly 100 includes a pressing surface layer 10, a pattern layer 20, a first adhesive layer 30, an elastic layer 40, a second adhesive layer 50, a light guiding layer 60, a third adhesive layer 70 and a pressing bottom layer 80.

The pressing surface layer 10 can be made of transparent and elastic thermoplastic macromolecule materials such as rubber, thermoplastic polyurethane or a combination thereof. A thickness of the pressing surface layer 10 is in the range of about 0.1-about 0.2 mm (millimeter) and is preferably about 0.2 mm. The pressing surface layer 10 has a top surface 12 and an opposite bottom surface 14. The top surface 12 has a plurality of key profiles 122 formed thereon. The profiles 122 may protrude from the top surface 12 or may be recessed in top surface 12. In the exemplary embodiment, the profiles 122 protrude from the top surface 12. Each profile 122 can be substantially ring-shaped. A thickness of the profile 122 is in the range of about 0.2-about 0.3 mm and is preferably about 0.2 mm. The profiles 122 can be formed by hot press molding. The location of the profiles 122 on the pressing surface layer 10 identify the locations of keys formed on the keypad assembly 100.

The pattern layer 20 includes a hard layer 22, and a printing ink layer 24 formed on one surface of the hard layer 22. The hard layer 22 is a transparent and can be made of thermoplastic macromolecule material such as polycarbonate, polyethylene terephthalate or a combination thereof. The printing ink layer 24 has a plurality of icons 26 formed thereon. In this exemplary embodiment, the printing ink layer 24 has a background color printed or applied thereon and the icons 26 are printed on or applied thereto in a contrasting color. Each icon 26 corresponds to a profile 122. The hard layer 22 contacts the bottom surface 14 of the pressing surface layer 10 after the pattern layer 20 is assembled to the pressing surface layer 10. A thickness of the pattern layer 20 is in the range of about 0.1-about 0.2 mm and is preferably about 0.125 mm.

The first adhesive layer 30 is transparent double-face adhesive layer and substantially rectangular. The first adhesive layer 30 has a thickness in the range of about 0.1-about 0.2 mm and is preferably about 0.1 mm. The shape of the first adhesive 30 is similar with the shape of the pattern layer 20, and the size of the first adhesive layer 30 is smaller than the size the pattern layer 20. The first adhesive layer 30 adheres the pattern layer 20 to the elastic layer 40.

The elastic layer 40 can be made of transparent and elastic thermoplastic macromolecule materials such as rubber, thermoplastic polyurethane or a combination thereof. The surface size of the elastic layer 40 is same as the surface size of the first adhesive layer 30. A thickness of the elastic layer 40 is in the range of about 0.1-about 0.2 mm and is preferably about 0.2 mm. A bottom surface of the elastic layer 40 has a plurality of columns 42 formed thereon. The thickness of a column 42 is in the range of about 0.2-about 0.3 mm and is preferably about 0.25 mm. Each column 42 can be formed by hot press molding the elastic layer 40. Each column 42 corresponds to an icon 26 after the elastic layer 40 is affixed to the pattern layer 20 by the first adhesive layer 30.

The second adhesive layer 50 is a transparent double-face adhesive layer and is a substantially hollow rectangular frame. The shape of the second adhesive layer 50 corresponds to a peripheral edge of the pattern layer 20. The thickness of the second adhesive layer 50 is in the range of about 0.1-about 0.2 mm and is preferably about 0.1 mm. The second adhesive layer 50 interconnects the pattern layer 20 and a housing (not shown) of an electronic device together.

The light guiding layer 60 is made of transparent and plastic macromolecule material such as polyimide. A surface size of the light guiding layer 60 is the same as the surface size of the elastic layer 40. A thickness of the light guiding layer 60 is in the range of about 0.1-about 0.2 mm and is preferably about 0.125 mm. The light guiding layer 60 is associated with a light source (not shown) contained within the electronic device and has a plurality of focusing areas 62 formed thereon. Each focusing area 62 corresponds to an icon 26 of the pattern layer 20 and is formed by printing. In this exemplary embodiment, the focusing areas 62 are in circular shapes and printed on the light guiding layer 60 by white printing ink. Light rays from the light source (neither shown) inside of electronic device will be collected in the focusing areas 62 and directed towards the icons 26, thereby increasing the brightness of the icon 26.

The third adhesive layer 70 is a transparent double-faced adhesive layer. The third adhesive layer 70 includes glue pieces 72. A thickness of the glue piece 72 is in the range of about 0.1-about 0.2 mm and is preferably about 0.1 mm. The third adhesive layer 70 interconnects the pressing bottom layer 80 and the light guiding layer 60 together.

The pressing bottom layer 80 can be made of a transparent and thermoplastic macromolecule material such as polycarbonate, polyethylene terephthalate or a combination thereof. The pressing bottom layer 80 has a plurality of protrusions 82 formed on a first surface thereof and a plurality of concaves 84 formed on opposite second surface thereof corresponding to the protrusions 82. The protrusions 82 and the concaves 84 can be formed by hot press molding. The first surface of the pressing bottom layer 80 has a metal mesh 83 printed thereon. A wire 86 formed at a side of the pressing bottom layer 80 is electronically connected at one end to the metal mesh 83 and the other end is connected to the grounded circuit (not shown) of the electronic device. The wire 86 can remove the static electricity formed in the keypad assembly 100. The second surface of the pressing bottom layer 80 has a plurality metal domes 88 mounted in the concaves 84. The metal domes 88 protrude from the concave 84. The metal domes 88 are used for resisting the switches (not shown) formed on a circuit board of the electronic device.

In assembly, the pressing surface layer 10 and the pattern layer 20 are connected and stacked together by hot pressing molding, each profile 122 of the pressing surface layer 10 corresponds to an icon 26. The pattern layer 20 is adhered to the elastic layer 40 by the first adhesive layer 30, with the peripheral edge of the pattern layer 20 exposed from the elastic layer 40 and each icon 26 corresponding to a column 42. The second adhesive layer 50 is adhered to the peripheral edge of the pattern layer 20 and the housing of electronic device. The guiding layer 60 is adhered to the first surface of the pressing bottom layer 80 by the glue pieces 72, each focusing area 62 corresponds to a protrusion 82. The guiding layer 60 together with the pressing bottom layer 80 are clamped between the elastic layer 40 and the circuit board of the electronic device. Each column 42 corresponds to a focusing area 62, the metal domes 88 of the pressing bottom layer 80 contacts the switches of the circuit board.

When using the keypad assembly 100, a desired profile 122 is pressed to further press the columns 42 of the elastic layer 40 such that the columns 42 resist the protrusions 82. Because the column 42 is elastic, the column 42 has a buffering effect when pressed. Accordingly, the user will not feel the obvious resisting force, so the user can feel more comfortable when pressing. The light guiding layer 60 has a plurality of focusing areas 62, the focusing areas 62 can collect light rays under the pressing bottom layer 80 to make the appearance of the icons 26 brighter. The wire 86 connects the metal mesh 83 and the grounded circuit of the electronic device to effectively eliminate static electricity.

It should be understood that the icons 26 may be formed on the bottom surface 14 of the pressing surface layer 10.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A keypad assembly comprising:

a pressing surface layer having at least one profile formed thereon;

a pattern layer mounted to the pressing surface layer and having at least one icon formed thereon, the at least one icon corresponding to the at least one profile;

an elastic layer located under the pattern layer and having at least one column formed thereon, the at least one column corresponding to the at least one icon;

a light guiding layer located under the elastic layer and having at least one focusing area formed thereon, the at least one focusing area corresponding to the at least one column; and a pressing bottom layer located under the light guiding layer and having a metal mesh printed on one surface and at least one metal dome on the other surface opposite to the metal mesh, the at least one metal dome corresponding to the at least one focusing area, the metal mesh abutting the light guiding layer to eliminate static electricity of the light guiding layer.

2. The keypad assembly as claimed in claim 1, wherein one of the pressing surface layer and the elastic layer is made of a transparent and elastic macromolecule material.

3. The keypad assembly as claimed in claim 1, further comprising a first adhesive layer configured for interconnecting the elastic layer and the pattern layer together.

4. The keypad assembly as claimed in claim 3, further comprising a second adhesive layer configured for interconnecting the pattern layer and a housing of electronic device together.

5. The keypad assembly as claimed in claim 4, further comprising a third adhesive layer configured for interconnecting the pressing bottom layer and the light guiding layer together.

6. The keypad assembly as claimed in claim 5, wherein each of the pressing surface layer, the pattern layer, the first adhesive layer, the elastic layer, the second adhesive layer, the light guiding layer and the third adhesive layer have a thickness in the range of about 0.1-about 0.2 mm.

7. The keypad assembly as claimed in claim 1, wherein the pressing surface layer has a top surface, the at least one profile is formed on the top surface.

8. The keypad assembly as claimed in claim 7, wherein the pattern layer includes a hard layer and a printing ink layer formed at one surface of the hard layer, the printing ink layer has the icons formed thereon.

9. The keypad assembly as claimed in claim 1, wherein the profile of the pressing surface layer is substantially ring-shaped.

10. The keypad assembly as claimed in claim 1, wherein a thickness of the at least one profile of the pressing surface layer is in the range of about 0.2-about 0.3 mm.

11. The keypad assembly as claimed in claim 1, wherein each of the pattern layer and the pressing bottom layer is made of a transparent and thermoplastic macromolecule material.

12. The keypad assembly as claimed in claim 1, wherein each of the pattern layer and the pressing bottom layer is made of polycarbonate or polyethylene terephathalate, or a combination thereof.

13. The keypad assembly as claimed in claim 1, wherein the light guiding layer is made of polyimide.

14. The keypad assembly as claimed in claim 1, wherein the at least one focusing area is configured for focusing the light transmitted therethrough.

15. The keypad assembly as claimed in claim 1, wherein the pressing bottom layer has at least one concave formed thereof, at least one metal dome of the pressing bottom layer is mounted in a concave.

* * * * *